US010612547B2

(12) United States Patent
Sakai et al.

(10) Patent No.: US 10,612,547 B2
(45) Date of Patent: Apr. 7, 2020

(54) FUEL PUMP

(71) Applicant: DENSO CORPORATION, Kariya, Aichi-pref (JP)

(72) Inventors: Hiromi Sakai, Kariya (JP); Daiji Furuhashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 356 days.

(21) Appl. No.: 15/564,860

(22) PCT Filed: Aug. 8, 2016

(86) PCT No.: PCT/JP2016/073240

§ 371 (c)(1),
(2) Date: Oct. 6, 2017

(87) PCT Pub. No.: WO2017/033720

PCT Pub. Date: Mar. 2, 2017

(65) Prior Publication Data

US 2018/0087504 A1 Mar. 29, 2018

(30) Foreign Application Priority Data

Aug. 26, 2015 (JP) ..... 2015-167059

(51) Int. Cl.
*F04C 15/06* (2006.01)
*F04C 13/00* (2006.01)
(Continued)

(52) U.S. Cl.
CPC ..... *F04C 15/06* (2013.01); *F02M 37/08* (2013.01); *F04C 2/10* (2013.01); *F04C 2/102* (2013.01);
(Continued)

(58) Field of Classification Search
CPC ..... F04C 13/005; F04C 15/06; F04C 2/102
See application file for complete search history.

(56) References Cited

U.S. PATENT DOCUMENTS 2,871,831 A * 2/1959 Patin ..... F04C 2/104 418/61.3
3,695,791 A * 10/1972 Brundage ..... F04C 2/102 418/131
(Continued)

FOREIGN PATENT DOCUMENTS

JP 62-156177 10/1987
JP 9-025809 1/1997
(Continued)

OTHER PUBLICATIONS

International Search Report for PCT/JP2016/073240, dated Sep. 13, 2016, 4 pages.
(Continued)

*Primary Examiner* — Mary Davis
(74) *Attorney, Agent, or Firm* — Nixon & Vanderhye P.C.

(57) ABSTRACT

A pump housing includes: a slide surface, along which inner and outer gears are slid; a suction guide passage, which is recessed from the slide surface and guides the fuel at a suction side; a discharge passage, which is recessed from the slide surface-and guides the fuel at a discharge side; and a communication groove, which is recessed from the slide surface and is shaped into an arcuate form that extends along a circumcircle of the inner gear. The communication groove is communicated with the suction groove and the discharge passage through two opposite groove end parts, respectively, of the communication groove.

6 Claims, 5 Drawing Sheets

(51) Int. Cl.
*F04C 2/10* (2006.01)
*F02M 37/08* (2006.01)
*F04C 11/00* (2006.01)

(52) U.S. Cl.
CPC ..... *F04C 11/008* (2013.01); *F04C 13/005* (2013.01); *F04C 2210/1044* (2013.01); *F04C 2230/602* (2013.01); *F04C 2240/40* (2013.01); *F05C 2253/20* (2013.01)

(56) References Cited

U.S. PATENT DOCUMENTS 5,711,660 A * 1/1998 Mitarai ..... F04C 2/102 418/79
6,332,522 B1 * 12/2001 Morse ..... F16D 43/284 192/35

FOREIGN PATENT DOCUMENTS

| | | |
|---|---|---|
| JP | 2008-001251 | 1/2008 |
| JP | 2009-138528 | 6/2009 |
| JP | 2010-025029 | 2/2010 |
| JP | 2011-122548 | 6/2011 |
| JP | 2013-060901 | 4/2013 |
| JP | 2015-500953 | 1/2015 |

OTHER PUBLICATIONS

Written Opinion of the ISA for PCT/JP2016/073240, dated Sep. 13, 2016, 3 pages.

* cited by examiner

FUEL PUMP

CROSS REFERENCE TO RELATED APPLICATION

This application is the U.S. national phase of International Application No. PCT/JP2016/073240 filed Aug. 8, 2016, and is based on and incorporates herein by reference Japanese Patent Application No. 2015-167059 filed on Aug. 26, 2015.

TECHNICAL FIELD

The present disclosure relates to a fuel pump that suctions fuel and discharges the suctioned fuel.

BACKGROUND

Previously, the patent literature 1 discloses a pump as a technique that is applicable in a fuel pump, which suctions fuel and discharges the suctioned fuel. This pump has: an outer gear, which includes a plurality of internal teeth; an inner gear, which includes a plurality of external teeth and is meshed with the outer gear while the inner gear is eccentric to the outer gear in an eccentric direction; and a pump housing, which rotatably receives the outer gear and the inner gear. When the outer gear and the inner gear are rotated to increase and decrease volumes of a plurality of pump chambers, which are formed between the outer gear and the inner gear, fuel is sequentially drawn into and is discharged from the pump chambers.

The pump housing includes: a pair of slide surfaces, which hold the outer gear and the inner gear from two opposite sides, respectively, in an axial direction, so that the outer gear and the inner gear are slid along the pair of slide surfaces; a suction guide passage that is recessed from the slide surface and guides liquid at a suction side; and a discharge guide passage that is recessed from the slide surface and guides the liquid at a discharge side.

Furthermore, the pump housing includes a pressure drain passage that is shaped into a linear form and communicates between the suction guide passage and the discharge guide passage. The pressure drain passage limits application of an excess load to the electric motor that is caused by exertion of a pressure, which is larger than a discharge capacity of the fuel pump.

The fuel pump may possibly suction foreign objects contained in the fuel. In the pump housing, at tooth tips of the external teeth of the inner gear, the inner gear and the outer gear can be brought close to each other, and thereby a density of the foreign objects can become particularly high. The foreign objects, which are present at the proximity location where the inner gear and the outer gear are brought into close proximity to each other, may possibly be slid along the slide surface in an area where a relief path, such as a guide passage, is absent. The inventors of the present application have found that slide scratches are generated at the slide surface along a circumcircle of the inner gear due to the sliding of the foreign objects such that a depth of the slide scratches is progressively deepened through use of the fuel pump. A pump efficiency may be deteriorated due to fuel leakage from the discharge guide passage to the suction guide passage.

The pressure drain groove of the patent literature 1, which is shaped into the linear form, may possibly enable relief of the foreign objects of the proximity location at a location where the circumcircle of the inner gear overlaps with the pressure drain groove. However, at a location, at which the circumcircle of the inner gear does not overlap with the pressure drain groove, the foreign objects of the proximity location are slid along the slide surface to cause generation of the slide scratches. In contrast, in a case where a width of the pressure drain groove, which is shaped into the linear form, is increased to cover all of the circumcircle, the suction guide passage and the discharge guide passage are substantially connected together to significantly deteriorate the pump efficiency.

CITATION LIST

Patent Literature

PATENT LITERATURE 1: JP2010-25029A

SUMMARY OF INVENTION

The present disclosure is made in view of the above disadvantage, and it is an objective of the present disclosure to provide a fuel pump that limits a reduction in a pump efficiency through use of the fuel pump.

Means for Addressing Objective

A fuel pump of the present disclosure includes:

an outer gear that includes a plurality of internal teeth;

an inner gear that includes a plurality of external teeth and is meshed with the outer gear while the inner gear is eccentric to the outer gear; and a pump housing that rotatably receives the outer gear and the inner gear, wherein:

when the outer gear and the inner gear are rotated to increase and decrease volumes of a plurality of pump chambers, which are formed between the outer gear and the inner gear, fuel is sequentially drawn into and is discharged from the plurality of pump chambers; and the pump housing includes:

- a pair of slide surfaces, which hold the outer gear and the inner gear from two opposite sides, respectively, in an axial direction, so that the outer gear and the inner gear are slid along the pair of slide surfaces;
- a suction guide passage that is recessed from at least one of the pair of slide surfaces and guides fuel at a suction side;
- a discharge guide passage that is recessed from the slide surface, at which the suction guide passage is formed, wherein the discharge guide passage guides the fuel at a discharge side; and
- a communication groove that is recessed from the slide surface, at which the suction guide passage and the discharge guide passage are formed, wherein the communication groove is shaped into an arcuate form that extends along a circumcircle of the inner gear, and the communication groove is communicated with the suction guide passage and the discharge guide passage through two opposite groove end parts, respectively, of the communication groove.

In this fuel pump, the pump housing, which rotatably receives the outer gear and the inner gear, includes the communication groove that is recessed from the slide surface, along which the outer gear and the inner gear are slid and at which the suction guide passage and the discharge guide passage are formed. Here, even in the case where the density of the foreign objects mixed in the fuel is increased at the proximity location, at which the inner and outer gears are brought into close proximity to each other near the tooth tips of the external teeth of the inner gear, since the communication groove is shaped into the arcuate form that extends along the circumcircle of the inner gear, the foreign objects, which are present at the proximity location, can be efficiently relieved. Furthermore, the communication groove is communicated with the suction guide passage and the discharge guide passage through the groove end parts. Therefore, the foreign objects, which are relieved into the communication groove, will be relieved into the suction guide passage or the discharge guide passage. Therefore, the foreign objects will be less likely slid along the slide surface, and thereby the slide scratches are less likely generated at the slide surface along the circumcircle of the inner gear. As a result, it is possible to limit leakage of the fuel from the discharge guide passage to the suction guide passage caused by the progressive deepening of the slide scratches. Thus, it is possible to limit the deterioration of the pump efficiency that would be caused by the use of the fuel pump.

DESCRIPTION OF EMBODIMENTS

Hereinafter, an embodiment of the present disclosure will be described with reference to the accompanying drawings.

Figure 1:
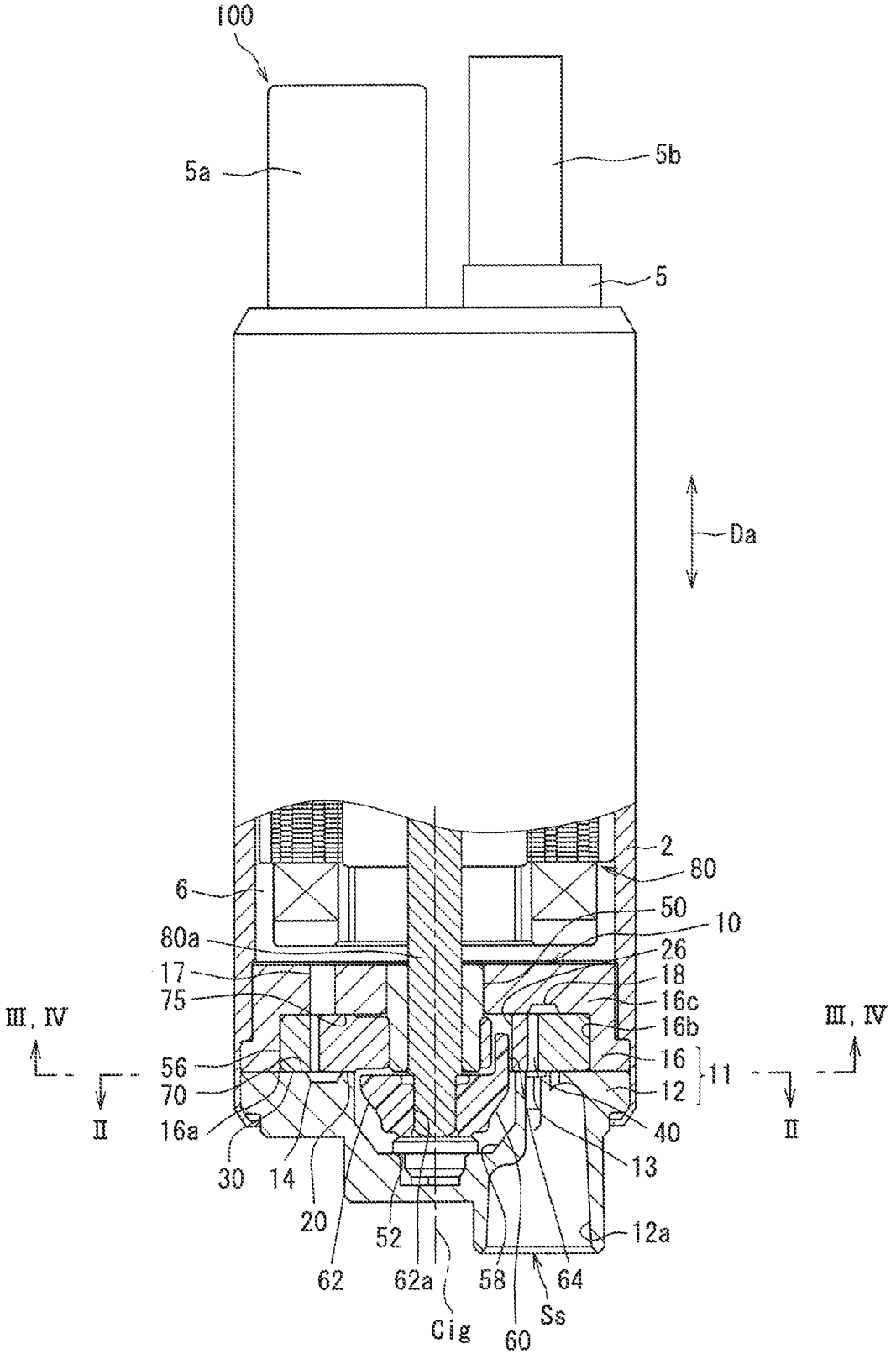
FIG. 1 is a partially fragmented front view of a fuel pump according to an embodiment.

As shown in FIG. 1, a fuel pump 100 according to the embodiment of the present disclosure is a positive-displacement trochoid pump. The fuel pump 100 is a diesel pump that is installed to a vehicle and is used to pump light oil, which serves as fuel used for combustion in an internal combustion engine. The fuel pump 100 includes an electric motor 80 and a pump main body 10, which are received in an inside of a pump body 2 that is configured into a cylindrical tubular form. Furthermore, the fuel pump 100 includes a side cover 5 that projects to an outside from an opposite side of the pump body 2, which is opposite from the pump main body 10 while the electric motor 80 is interposed between the pump main body 10 and the side cover 5 in an axial direction Da. In this fuel pump 100, a rotatable shaft 80*a* of the electric motor 80 is rotated when an electric power is supplied to the electric motor 80 from an external circuit through an electric connector 5*a* of the side cover 5. An outer gear 30 and an inner gear 20 of the pump main body 10 are rotated by a drive force of the rotatable shaft 80*a*. In this way, fuel is drawn into and pressurized in a gear receiving chamber 56, which receives the gears 20, 30, and the pressurized fuel is discharged from a discharge port 5*b* of the side cover 5 through a fuel passage 6 located at an outside of the gear receiving chamber 56.

The fuel is stored in a fuel tank installed to the vehicle, and this fuel is drawn into the fuel pump 100 through a suction inlet 12*a* after passing through a suction filter. Foreign objects, such as sand, dust, rust of a tank of a gas station, may possibly be contained in the fuel in the fuel tank.

The light oil, which is used as the fuel, has the higher viscosity in comparison to gasoline and becomes jelly-like particularly in a low temperature state. Therefore, in order to smoothly suction of the light oil, an aperture size of the suction filter is set to be larger than that of the gasoline. Therefore, the foreign objects, which are mixed into the light oil, can be easily suctioned into the fuel pump 100.

The electric motor 80, which is used in the fuel pump 100 of the present embodiment, is an inner rotor brushless motor that includes magnets 104*b*, which form four magnetic poles, and coils, which are installed in six slots. For example, at a time of turning on of an ignition switch of the vehicle or a time of depressing an accelerator pedal of the vehicle, a positioning control operation of the electric motor 80 is executed to rotate the rotatable shaft 80*a* toward a drive rotation side or a counter-drive rotation side. Thereafter, a drive control operation, which rotates the rotatable shaft 80*a* from the position, at which the rotatable shaft 80*a* is positioned in the positioning control operation, toward the drive rotation side.

The drive rotation side refers to a positive direction of a rotational direction Rig (see FIG. 4), which will be described later. Furthermore, the counter-drive rotation side refers to a negative direction of the rotational direction Rig (see FIG. 4).

Hereinafter, the pump main body 10 will be described in detail with reference to FIGS. 2 to 6. The pump main body 103 includes a pump housing 11, the inner gear 20, a joint member 60 and the outer gear 30.

The pump housing 11 includes a pump cover 12 and a pump casing 16, which are placed one after another in the axial direction Da to form a cylindrical gear receiving chamber 56 that rotatably receives the gears 20, 30. Thereby, the pump housing 11 holds the gears 20, 30 from two opposite sides thereof in the axial direction Da, so that the pump housing 11 forms a pair of slide surfaces 70, 75, along which the gears 20, 30 are slid, as planar surfaces.

Figure 2:
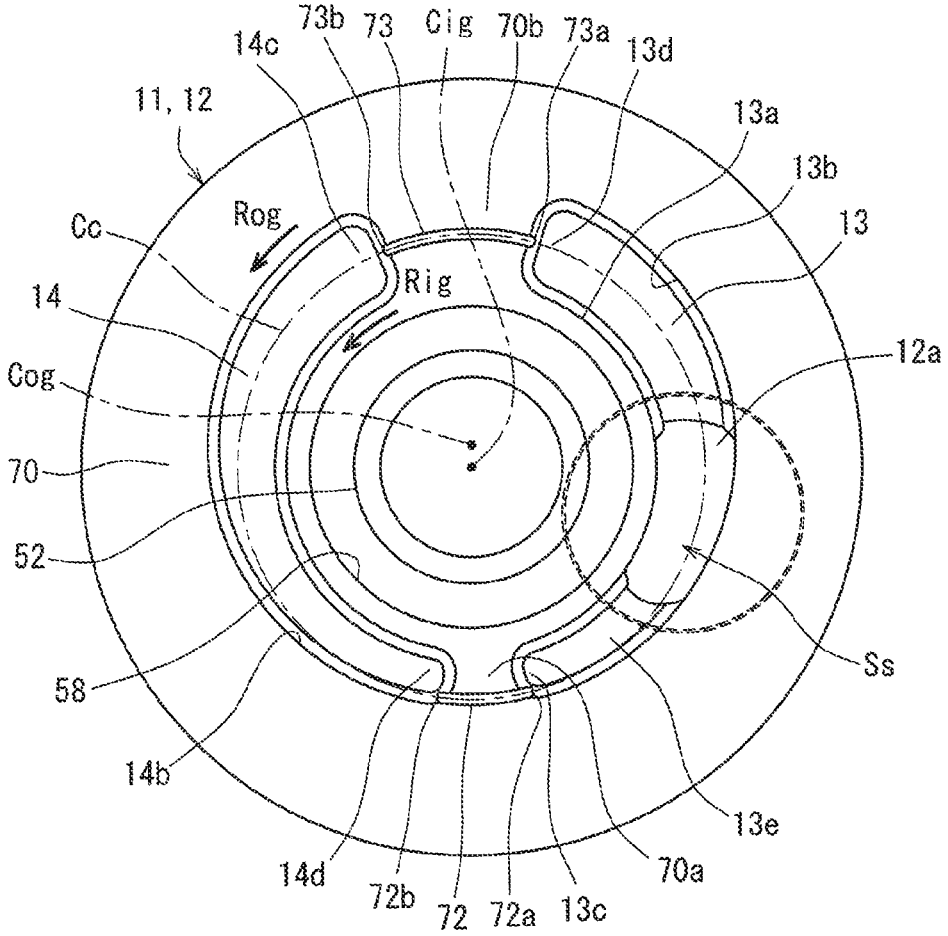
FIG. 2 is a plan view of a pump cover taken in a direction of an arrow II in FIG.

As shown in FIGS. 1 and 2, the pump cover 12 is a constituent component of the pump housing 11. The pump cover 12 is formed into a circular disk form having abrasion resistance that is implemented by applying a surface treatment, such plating, to a base material, which is made of rigid metal, such as iron steel. The pump cover 12 axially projects outward from an end part of the pump body 2, which is located on a side of the electric motor 80 that is opposite from the side cover 5 in the axial direction Da.

In order to draw the fuel from an outside of the fuel pump 100, the pump cover 12 has a suction inlet 12*a*, which is in a cylindrical form, and a suction passage 13, which is in a form of an arcuate groove. In the pump cover 12, the suction inlet 12*a* extends through a predetermined opening location Ss, which is eccentric from an inner central axis Cig of the inner gear 20, in the axial direction Da. The suction passage 13 extends from the slide surface 70 of the pump cover 12 and opens on the gear receiving chamber 56 side of the pump cover 12. As shown particularly in FIG. 2, an inner peripheral edge portion 13*a* of the suction passage 13 has a circumferential extent, which is less than one half of an entire circumference of the inner gear 120 in the rotational direction Rig. An outer peripheral edge portion 13*b* of the suction passage 13 has a circumferential extent, which is less than one half of an entire circumference of the outer gear 130 in the rotational direction Rog (also see FIG. 4).

The suction passage 13 extends from a start end portion 13*c* to a terminal end portion 13*d* in the rotational direction Rig, Rog such that a width of the suction passage 13 progressively increases in the rotational direction Rig, Rog from the start end portion 13*c* to the terminal end portion 13*d*. The suction inlet 12*a* opens in a groove bottom portion 13*e* of the suction passage 13 at the opening area Ss, so that the suction passage 13 is communicated with the suction inlet 12*a*. As shown particularly in FIG. 2, in an entire range of the opening area Ss, in which the suction inlet 12*a* opens, the width of the suction passage 13 is set to be smaller than a width of the suction inlet 12*a*.

Figure 3:
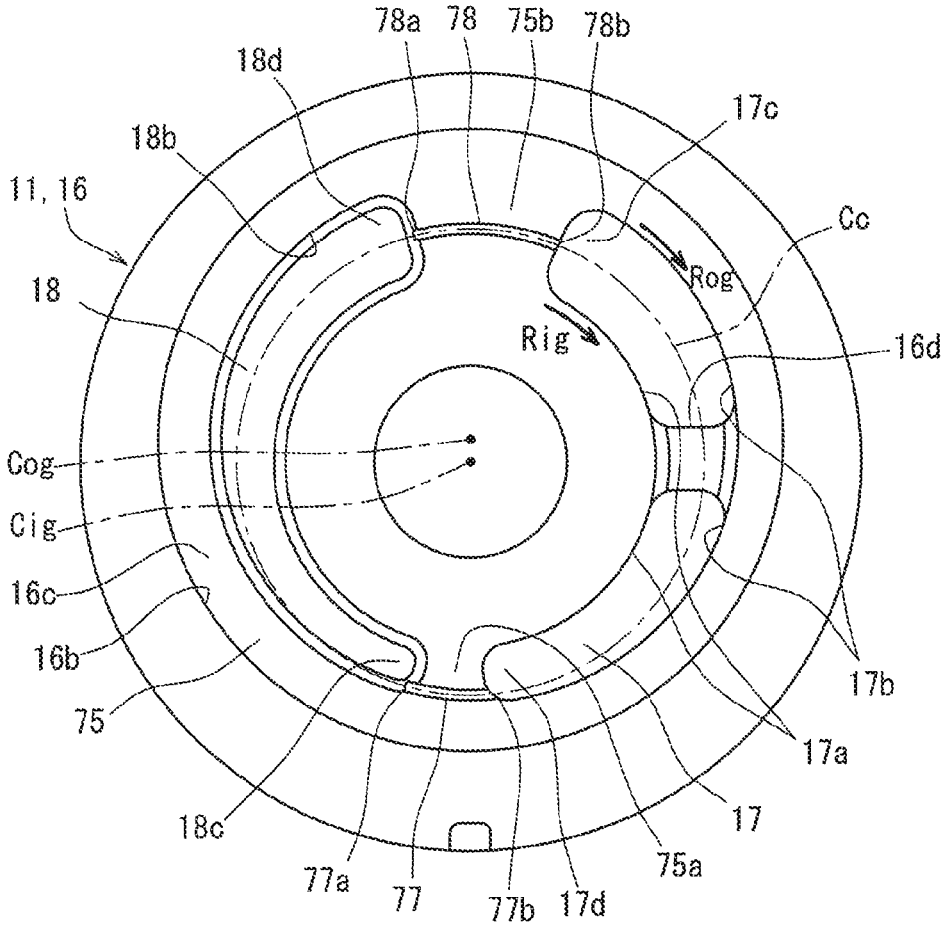
FIG. 3 is a plan view of a pump casing taken in a direction of an arrow III in FIG. 1.
Figure 4:
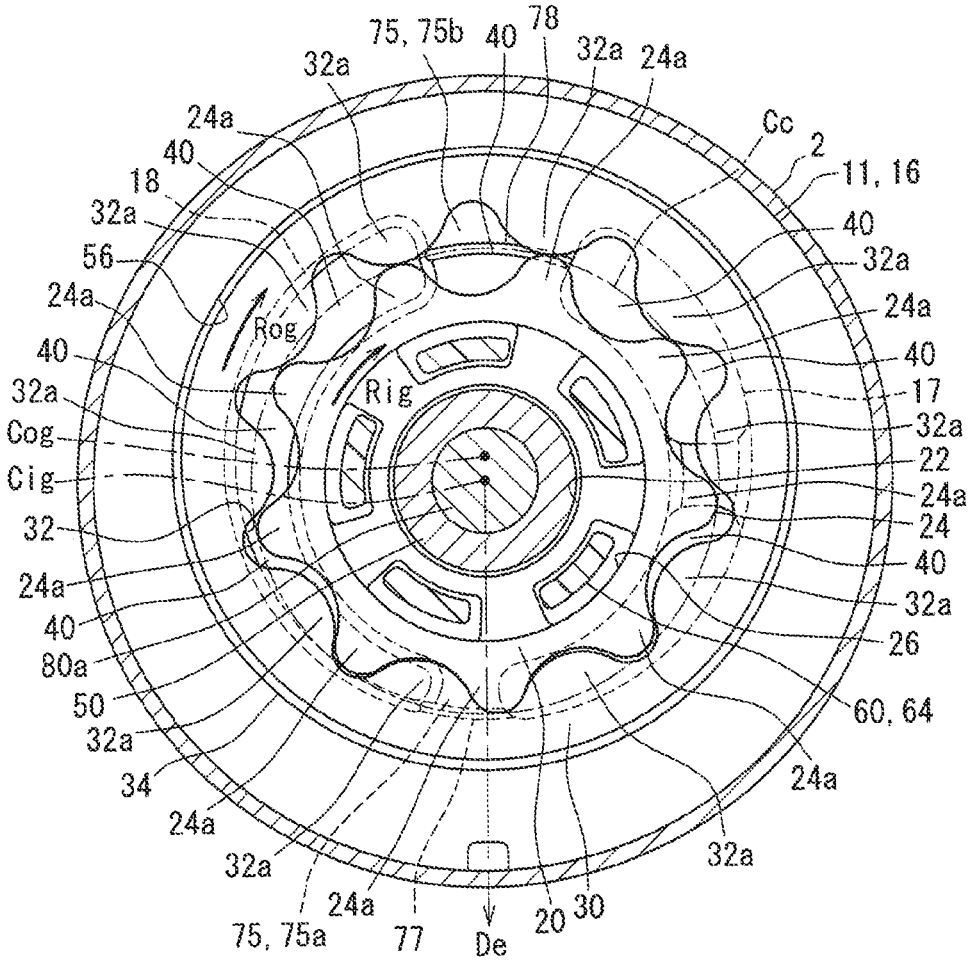
FIG. 4 is a cross sectional view taken along line IV-IV in FIG. 1.

As shown in FIGS. 1, 3 and 4, the pump casing 16 is a constituent component of the pump housing 11. The pump casing 16 is formed into a bottomed cylindrical form having abrasion resistance that is implemented by applying a surface treatment, such plating, to a base material, which is made of rigid metal, such as iron steel. An opening portion 16*a* of the pump casing 16 is covered with the pump cover 12 such that an entire circumferential extent of the opening portion 16*a* is tightly dosed by the pump cover 12. An inner peripheral portion 16*b* of the pump casing 16 is formed as a cylindrical hole that is eccentric relative to the inner central axis Cig.

The pump casing 16 forms a discharge passage 17, which is formed as an arcuate hole, to discharge the fuel from the gear receiving chamber 56. The discharge passage 17 extends from the slide surface 75 of the pump casing 16 and extends through a recessed bottom portion 16*c* of the pump casing 116 in the axial direction Da. As shown particularly in FIG. 3, an inner peripheral edge portion 17*a* of the discharge passage 17 has a circumferential extent, which is less than one half of an entire circumference of the inner gear 20 in the rotational direction Rig. An outer peripheral edge portion 17*b* of the discharge passage 17 has a circumferential extent, which is less than one half of the entire circumference of the outer gear 130 in the rotational direction Rog. A width of the discharge passage 17 progressively decreases in the rotational direction Rig, Rog from a start end portion 17*c* to a terminal end portion 17*d*.

Furthermore, the pump casing 16 includes a reinforcing rib 16*d* in the discharge passage 17. The reinforcing rib 16*d* is formed integrally with the pump casing 16 such that the reinforcing rib 16*d* extends across the discharge passage 17 in a crossing direction, which crosses the rotational direction Rig of the inner gear 20, and thereby the reinforcing rib 16*d* reinforces the pump casing 16.

A suction groove 18 shown particularly in FIG. 3 is formed in the recessed bottom portion 16*c* of the pump casing 16 at a corresponding area that is opposed to the suction passage 13 in the axial direction while pump chambers 40 (described later in detail) are interposed between the suction groove 18 and the suction passage 13 in the axial direction. The suction groove 18 is an arcuate groove that corresponds to a shape, which is produced by projecting the suction passage 13 onto the pump casing 16 in the axial direction. The suction groove 18 is recessed from the slide surface 75 and opens to the gear receiving chamber 56 side of the pump casing 16. In this way, in the pump casing 16, the discharge passage 17 and the suction groove 18 are generally symmetrical to each other about a symmetry axis.

The slide surface 75 of the pump casing 16 includes an eccentric side partition 75*a* and an opposite side partition 75*b*. The eccentric side partition 75*a* is located on an eccentric side of the inner gear 20 described later in detail and partitions between a start end portion 18*c* of the suction groove 18 and the terminal end portion 17*d* of the discharge passage 17. A communication groove 77 is formed in the eccentric side partition 75*a*. The opposite side partition 75*b* is located on an opposite side of an outer rotational axis Cog (serving as a rotational center of the outer gear 30), which is opposite from the eccentric side, and the opposite side partition 75*b* partitions between a terminal end portion 18*d* of the suction groove 18 and the start end portion 17*c* of the discharge passage 17. A communication groove 78 is also formed in the opposite side partition 75*b*.

As shown particularly in FIG. 2, a discharge groove 14 is formed in the pump cover 12 at a corresponding area that is opposed to the discharge passage 17 in the axial direction while the pump chambers 40 are interposed between the discharge groove 14 and the discharge passage 17 in the axial direction. The discharge groove 14 is formed in a form of an arcuate groove that is shaped to correspond with a shape, which is produced by projecting the discharge passage 17 onto the pump cover 12 in the axial direction Da. The discharge groove 14 is recessed from the slide surface 70 and opens to the gear receiving chamber 56 side of the pump cover 12. In this way, in the pump cover 12, the suction passage 13 and the discharge groove 14 are generally symmetrical to each other about the symmetry axis while the joint receiving chamber 58 is interposed between the suction passage 13 and the discharge groove 14.

The slide surface 70 of the pump cover 12 includes an eccentric side partition 70*a* and an opposite side partition 70*b*. The eccentric side partition 70*a* is located on an eccentric side of inner gear 20 and partitions between the start end portion 13*c* of the suction passage 13 and the terminal end portion 14*d* of the discharge groove 14. A communication groove 72 is formed in the eccentric side partition 70*a*. The opposite side partition 70*b* is located on an opposite side of the outer rotational axis Cog, which is opposite from the eccentric side, and the opposite side partition 70*b* partitions between the terminal end portion 13*d* of the suction passage 13 and the start end portion 14*c* of the discharge groove 14. A communication groove 73 is also formed in the opposite side partition 70*b*.

As discussed above, the suction passage 13 of the pump cover 12 and the suction groove 18 of the pump casing 16 are formed as a suction guide passage that guides the fuel at the suction side. Furthermore, the discharge groove 14 of the pump cover 12 and the discharge passage 17 of the pump casing 16 are formed as a discharge guide passage that guides the fuel at the discharge side.

The joint receiving chamber 58 of the pump cover 12 is recessed from the slide surface 70 in the axial direction Da at a location, which is located along the inner central axis Cig and is opposed to the inner gear 20. Thus, the joint receiving chamber 58 is located on one side of the outer gear 30 and the inner gear 20 in the axial direction Da and is communicated with the gear receiving chamber 56, and thereby the joint receiving chamber 58 rotatably receives a main body portion 62 of the joint member 60, which will be described later.

As shown particularly in FIG. 1, a radial bearing 50 is securely fitted in the recessed bottom portion 16*c* of the pump casing 16 along the inner central axis Cig to rotatably support the rotatable shaft 80*a* of the electric motor 80, which extends through the recessed bottom portion 16*c*, in the radial direction. A thrust bearing 52 is securely fitted to a bottom portion of the joint receiving chamber 58 along the inner central axis Cig in the pump cover 12 to rotatably support the rotatable shaft 80*a* in the axial direction Da.

The inner gear 20 and the outer gear 30 are trochoid gears, which have a trochoid tooth profile.

Specifically, the inner gear 20, which is shown in FIGS. 1 and 4, shares the inner central axis Gig with the rotatable shaft 80*a*, so that the inner gear 20 is eccentrically placed in the gear receiving chamber 56. Furthermore, a thickness of the inner gear 20 is slightly smaller than a corresponding size of the gear receiving chamber 56, which is shaped into a cylindrical tubular form. In this way, the inner peripheral portion 22 of the inner gear 20 is rotatably supported by the radial bearing 50 in the radial direction, and two opposite axial sides of the inner gear 20, which are opposite to each other in the axial direction Da, are rotatably supported by the slide surfaces 70, 75, respectively.

Furthermore, the inner gear 20 includes a plurality of insertion holes 26, which are recessed in the axial direction Da, are provided at a corresponding location of the inner gear 20 that is opposed to the joint receiving chamber 58. The insertion holes 26 are arranged one after another at equal intervals in the circumferential direction, and each insertion hole 26 extends through the inner gear 20 to the recessed bottom portion 16*c* side.

Figure 5:
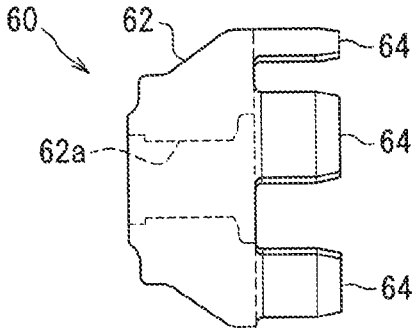
FIG. 5 is a front view of a joint member according to the embodiment.
Figure 6:
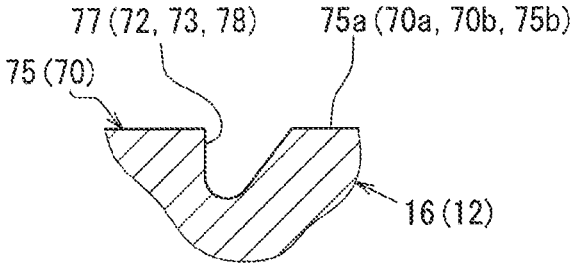
FIG. 6 is a cross sectional view of a communication groove according to the embodiment.

The joint member 60, which is shown in FIGS. 1, 4 and 5, is made of synthetic resin, such as poly phenylene sulfide (PPS) resin. The joint member 60 relays the rotatable shaft 80*a* to the inner gear 20 to rotate the gears 20, 30. The joint member 60 includes a main body portion 62 and a plurality of inserting portions 64. The main body portion 62 is fitted to the rotatable shaft 80*a* through a fitting hole 62*a* of the main body portion 62 in the joint receiving chamber 58. The inserting portions 64 are provided to respectively correspond to the insertion holes 26. Specifically, each of the number of the insertion holes 26 and the number of the inserting portions 64 of the present embodiment is set to a number that is other than the number of the polarities and the number of the slots of the electric motor 80 to reduce the influence of the torque ripple of the electric motor 80. Particularly, each of the number of the insertion holes 26 and the number of the inserting portions 64 of the present embodiment is set to five that is a prime number. Each inserting portion 64 extends in the axial direction Da from a corresponding location of the main body portion 62, which is located on a radially outer side of the fitting hole 62*a*.

The inserting portions 64 are respectively inserted into the insertion holes 26 such that a gap is formed between each inserting portion 64 and the corresponding insertion hole 26. When the rotatable shaft 80*a* is rotated toward the drive rotation side, each inserting portion 64 is urged against an inner wall of the corresponding insertion hole 26. Thereby, the drive force of the rotatable shaft 80*a* is transmitted to the joint member 60. That is, the inner gear 20 is rotatable in the rotational direction Rig about the inner central axis Cig. In FIG. 4, only one of the insertion hole 26 and only one of the inserting portion 64 are indicated with the corresponding reference signs.

As shown in FIG. 4, the inner gear 20 includes a plurality of external teeth 24*a*, which are formed at an outer peripheral portion 24 of the inner gear 20 and are arranged one after another at equal intervals in the rotational direction Rig. Tooth tips of the external teeth 124*a*, each of which radially outwardly projects from a tooth bottom of the external tooth 124*a*, are placed one after another along a circumcircle Cc (also referred to as an addendum circle). Each of the external teeth 124*a* can axially oppose each of the passages 13, 17 and each of the grooves 14, 18 in response to the rotation of the inner gear 20. Thereby, it is possible to limit sticking of the inner gear 20 to the slide surfaces 70, 75.

As shown in FIGS. 1 and 4, the outer gear 30 is eccentric to the inner central axis Cig of the inner gear 20, so that the outer gear 30 is coaxially received in the gear receiving chamber 56. In this way, the inner gear 20 is eccentric to the outer gear 30 in an eccentric direction De, which is a radial direction of the outer gear 30.

An outer diameter and a thickness of the outer gear 30 are slightly smaller than corresponding sizes of the gear receiving chamber 56, which is shaped into a cylindrical tubular form. An outer peripheral portion 34 of the outer gear 30 is rotatably supported by the inner peripheral portion 16*b* of the pump casing 16, and two opposite axial sides of the outer gear 30, which are opposite to each other in the axial direction Da, are rotatably supported by the slide surfaces 70, 75, respectively. Thereby, the outer gear 30 is rotatable in the rotational direction Rig about the outer rotational axis Cog, which is eccentric to the inner central axis Cig, synchronously with the inner gear 20.

As shown in FIG. 4, the outer gear 30 includes a plurality of internal teeth 32*a*, which are arranged one after another at equal intervals in the rotational direction Rog at an inner peripheral portion 32 of the outer gear 30. The number of the internal teeth 32*a* of the outer gear 30 is set to be larger than the number of the external teeth 24*a* of the inner gear 20 by one. In the present embodiment, the number of the internal teeth 32*a* is ten, and the number of the external teeth 24*a* is nine. Each of the internal teeth 32*a* can oppose each of the passages 13, 17 and each of the grooves 14, 18 in the axial direction Da in response to the rotation of the outer gear 30. Thereby, it is possible to limit sticking of the outer gear 30 to the slide surfaces 70, 75.

Furthermore, a curvature of a tooth tip of each of the internal teeth 32*a* is set to be generally equal to a curvature of the tooth bottom of each of the external teeth 24*a*, and a curvature of a tooth bottom of each of the internal teeth 32*a* is set to be generally equal to a curvature of the tooth tip of each of the external teeth 24*a*. The curvature of the tooth tip of each of the external teeth 24*a* of the inner gear 20 is set to be larger than the curvature of the tooth tip of each of the internal teeth 32*a* of the outer gear 30.

The inner gear 20 is eccentric to the outer gear 30 in the eccentric direction De and is thereby meshed with the outer gear 30. Thereby, a gap between the gears 20, 30 is small at the eccentric side, and the pump chambers 40 are formed one after another between the gears 20, 30 at the opposite side, which is opposite from the eccentric side. A volume of each of the pump chambers 40 is increased and decreased when the outer gear 30 and the inner gear 20 are rotated.

In response to the rotation of the gears 20, 30, the volume of each corresponding pump chamber 40, which is opposed to and communicated with the suction passage 13 and the suction groove 18 that form the suction guide passage, is increased. Thereby, the fuel is drawn from the suction inlet 12*a* into each corresponding pump chamber 40 in the gear receiving chamber 56 through the suction passage 13. At this time, since the width of the suction passage 13 is progressively increased from the start end portion 13*c* to the terminal end portion 13*d* (see FIG. 2), the amount of fuel, which is drawn through the suction passage 13, corresponds to a volume increasing amount of the pump chamber 40.

In response to the rotation of the gears 20, 30, the volume of each corresponding pump chamber 40, which is opposed to and is communicated with the discharge passage 17 and the discharge groove 14 that form the discharge guide passage, is decreased. Thereby, simultaneously with the suctioning function, the fuel is discharged from each corresponding pump chamber 40 to the outside of the gear receiving chamber 56 through the discharge passage 17. At this time, since the width of the discharge passage 17 is progressively increased from the start end portion 17*c* to the terminal end portion 17*d* (see FIG. 3), the amount of fuel, which is discharged through the discharge passage 17, corresponds to a volume decreasing amount of the pump chamber 40.

The fuel, which is sequentially discharged through the discharge passage 17 after sequentially drawn into the pump chambers 40 through the suction passage 13, is discharged to the outside from the discharge port 5*b* through the fuel passage 6. Here, due to the pumping action described above, the fuel pressure at the discharge side becomes the high pressure state that is higher than the fuel pressure at the suction side.

Now, the communication grooves 72, 73, 77, 78 of the pump housing 11 will be described in details. As shown in FIGS. 3 and 4, the pump casing 16 includes the communication grooves 77, 78 that are recessed from the slide surface 75, in which the suction groove 18 and the discharge passage 17 are formed. The communication groove 77, which is formed at the eccentric side partition 75*a*, is communicated with the suction groove 18 through one groove end part 77*a* of the communication groove 77 and the start end portion 18*c* of the suction groove 18. Also, the communication groove 77 is communicated with the discharge passage 17 through the other groove end part 77*b* of the communication groove 77 and the terminal end portion 17*d* of the discharge passage 17. The communication groove 77 is shaped into an arcuate form that extends along the circumcircle Cc of the inner gear 20. Therefore, the communication groove 77 is communicated with the suction groove 18 through an intersection part of the start end portion 18*c*, which intersects with an outer peripheral edge portion 18*b* of the suction groove 18, and the communication groove 77 is also communicated with the discharge passage 17 through an intersecting part of the terminal end portion 17*d*, which intersects with the outer peripheral edge portion 17*b*. A width of the communication groove 77 is set to be sufficiently smaller than the width of the suction groove 18 and the width of the discharge passage 17. Furthermore, the width and a depth of the communication groove 77 are set to be substantially constant along the circumferential extent of the communication groove 77. As shown particularly in FIG. 6, in a longitudinal cross section of the pump casing 16, which is taken in the radial direction, the communication groove 77 is shaped into a generally triangular form that is a bit tip form.

The communication groove 78, which is formed at the opposite side partition 75*b*, is communicated with the suction groove 18 through one groove end part 78*a* of the communication groove 78 and the terminal end portion 18*d* of the suction groove 18. Also, the communication groove 78 is communicated with the discharge passage 17 through the other groove end part 78*b* of the communication groove 78 and the start end portion 17*c* of the discharge passage 17. The communication groove 78 is shaped into an arcuate form that extends along the circumcircle Cc of the inner gear 20. Therefore, the communication groove 78 is communicated with the suction groove 18 through an intermediate part of the terminal end portion 18*d*, and the communication groove 78 is also communicated with the discharge passage 17 through an intermediate part of the start end portion 17*c*. A width of the communication groove 78 is set to be sufficiently smaller than the width of the suction groove 18 and the width of the discharge passage 17. Furthermore, similar to the communication groove 77, the width and a depth of the communication groove 78 are set to be substantially constant along the circumferential extent of the communication groove 78, and a shape of a longitudinal cross section of the communication groove 78 is also substantially constant along the circumferential extent of the communication groove 77.

Thereby, the entire circumferential extent of the portion of the pump casing 16, which is opposed to the circumcircle Cc of the inner gear 20 in the axial direction Da, is recessed from the slide surface 75 by the suction groove 18, the discharge passage 17 and the communication grooves 77, 78.

As shown in FIG. 2, the pump cover 12 includes the communication grooves 72, 73 that are recessed from the slide surface 70, in which the suction passage 13 and the discharge groove 14 are formed. The communication groove 72, which is formed at the eccentric side partition 70*a*, is communicated with the suction passage 13 through one groove end part 72*a* of the communication groove 72 and the start end portion 13*c* of the suction passage 13. Also, the communication groove 72 is communicated with the discharge groove 14 through the other groove end part 72*b* of the communication groove 72 and the terminal end portion 14*d* of the discharge groove 14. The communication groove 72 is shaped into an arcuate form that extends along the circumcircle Cc of the inner gear 20. Therefore, the communication groove 72 is communicated with the suction passage 13 through an intersection part of the start end portion 13*c*, which intersects with the outer peripheral edge portion 13*b*, and the communication groove 72 is also communicated with the discharge groove 14 through an intersecting part of the terminal end portion 14*d*, which intersects with an outer peripheral edge portion 14*b* of the discharge groove 14. A width of the communication groove 72 is set to be sufficiently smaller than the width of the suction passage 13 and the width of the discharge groove 14. Furthermore, similar to the communication grooves 77, 78, the width and a depth of the communication groove 72 are set to be substantially constant along the circumferential extent of the communication groove 72, and a shape of a longitudinal cross section of the communication groove 72 is also substantially constant along the circumferential extent of the communication groove 72.

The communication groove 73, which is formed at the opposite side partition 70*b*, is communicated with the suction passage 13 through one groove end part 73*a* of the communication groove 73 and the terminal end portion 13*d* of the suction passage 13. Also, the communication groove 73 is communicated with the discharge groove 14 through the other groove end part 73*b* of the communication groove 73 and the start end portion 14*c* of the discharge groove 14. The communication groove 73 is shaped into an arcuate form that extends along the circumcircle Cc of the inner gear 20. Therefore, the communication groove 73 is communicated with the suction passage 13 through an intermediate part of the terminal end portion 13*d*, and the communication groove 73 is also communicated with the discharge groove 14 through an intermediate part of the start end portion 14*c*. A width of the communication groove 73 is set to be sufficiently smaller than the width of the suction passage 13 and the width of the discharge groove 14. Furthermore, similar to the communication grooves 72, 77, 78, the width and a depth of the communication groove 73 are set to be substantially constant along the circumferential extent of the communication groove 73, and a shape of a longitudinal cross section of the communication groove 73 is also substantially constant along the circumferential extent of the communication groove 73.

Thereby, the entire circumferential extent of the portion of the pump casing 16, which is opposed to the circumcircle Cc of the inner gear 20 in the axial direction Da, is recessed from the slide surface 70 by the suction passage 13, the discharge groove 14 and the communication grooves 72, 73.

(Advantages)

Hereinafter, advantages of the present embodiment will be described.

According to the present embodiment, the pump housing 11, which rotatably receives the outer gear 30 and the inner gear 20, is provided with the suction passage 13 and the suction groove 18, which serve as the suction guide passage, and the discharge passage 17 and the discharge groove 14, which serve as the discharge guide passage. The pump housing 11 has the communication grooves 72, 73, 77, 78 that are recessed from the slide surfaces 70, 75 along which the gears 20, 30 are slid. Here, even in the case where the density of the foreign objects mixed in the fuel is increased at the proximity location, at which the gears 20, 30 are brought into close proximity to each other near the tooth tips of the external teeth 24*a* of the inner gear 20, since the communication grooves 72, 73, 77, 78 are respectively shaped into the arcuate form that extends along the circumcircle Cc of the inner gear 20, the foreign objects, which are present at the proximity location can be efficiently relieved. Furthermore, the communication grooves 72, 73, 77, 78 are communicated with the suction guide passage and the discharge guide passage through the groove end parts 72*a*-72*b*, 73*a*-73*b*, 77*a*-77*b*, 78*a*-78*b*. Therefore, the foreign objects, which are relieved into the communication grooves 72, 73, 77, 78, will be relieved into the suction guide passage or the discharge guide passage. Therefore, the foreign objects will be less likely slid along the slide surfaces 70, 75, and thereby the slide scratches are less likely generated at the slide surfaces 70, 75 along the circumcircle Cc of the inner gear 20. As a result, it is possible to limit leakage of the fuel from the discharge guide passage to the suction guide passage caused by the progressive deepening of the slide scratches. Thus, it is possible to limit the deterioration of the pump efficiency that would be caused by the use of the fuel pump 100.

Furthermore, according to the present embodiment, the communication grooves 72, 73, 77, 78 are formed at least in the eccentric side partitions 70*a*, 75*a* among the eccentric side partitions 70*a*, 75*a* and the opposite side partitions 70*b*, 75*b*. At the eccentric side of the inner gear 20, the gears 20, 30 are meshed with each other in the state where the gears 20, 30 are brought into close proximity in comparison to the opposite side of the inner gear 20, which is opposite from the eccentric side. Therefore, in this proximity location at the eccentric side, the density of the foreign objects is likely to be increased. Even in such a case, the communication grooves 72, 77, which are formed at the eccentric side partitions 70*a*, 75*a*, relive the foreign objects. Therefore, the slide scratches are less likely generated at the eccentric side partitions 70*a*, 75*a*. As a result, it is possible to limit leakage of the fuel from the discharge guide passage to the suction guide passage caused by the progressive deepening of the slide scratches. Thus, it is possible to limit the deterioration of the pump efficiency that would be caused by the use of the fuel pump 100.

Furthermore, according to the present embodiment, the communication grooves 72, 73, 77, 78 are formed at both of the eccentric side partitions 70*a*, 75*a* and the opposite side partitions 70*b*, 75*b*. In this way, the generation of the slide scratches is limited at both of the partitions 70*a*-70*b*, 75*a*-75*b*. Therefore, it is possible to more reliably limit leakage of the fuel from the discharge guide passage to the suction guide passage caused by the progressive deepening of the slide scratches. Thus, it is possible to limit the deterioration of the pump efficiency that would be caused by the use of the fuel pump 100.

Furthermore, according to the present embodiment, the joint receiving chamber 58, which is recessed from the slide surface 70 at the one side of the gears 20, 30 in the axial direction Da, receives the joint member 60. Therefore, the gears 20, 30 are urged by the fuel, which is supplied into the joint receiving chamber 58, from the one side in the axial direction Da toward the opposite side of the joint receiving chamber 58, so that the gap between the slide surface 75 located on the opposite side and the gears 20, 30 is reduced to improve the sealing performance.

Here, the communication grooves 72, 73, 77, 78 are formed at least in the slide surface 75, which is opposite from the joint receiving chamber 58. The generation of the slide scratches in the slide surface 75 is limited by the communication grooves 77, 78, which are formed in the slide surface 75. Therefore, the sealing performance between the slide surface 75 and the gears 20, 30 can be maintained. Thus, it is possible to limit the deterioration of the pump efficiency that would be caused by the use of the fuel pump 100.

Furthermore, according to the present embodiment, the communication grooves 72, 73, 77, 78 are formed at the two opposite sides of the gears 20, 30, which are opposite to each other in the axial direction Da. In this way, the generation of the slide scratches is limited at the two opposite sides of the gears 20, 30, and thereby the leakage of the fuel can be limited. Thus, it is possible to limit the deterioration of the pump efficiency that would be caused by the use of the fuel pump 100.

Other Embodiments

The embodiment of the present disclosure has been described. However, the present disclosure should not be limited to the above embodiment, and the present disclosure can be implemented in various other embodiments within the scope of the present disclosure.

Figure 7:
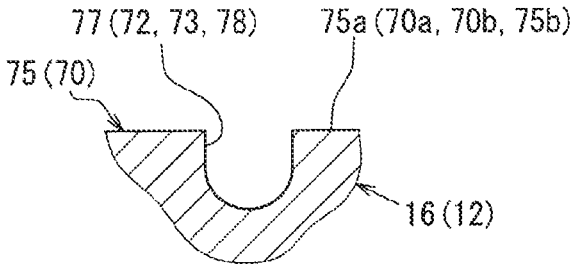
FIG. 7 is a view that corresponds to FIG. 6 showing an example of a first modification.
Figure 8:
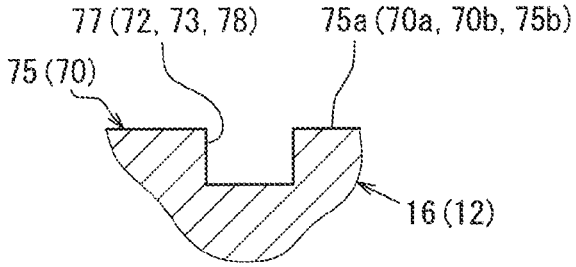
FIG. 8 is a view that corresponds to FIG. 6 showing another example of the first modification.
Figure 9:
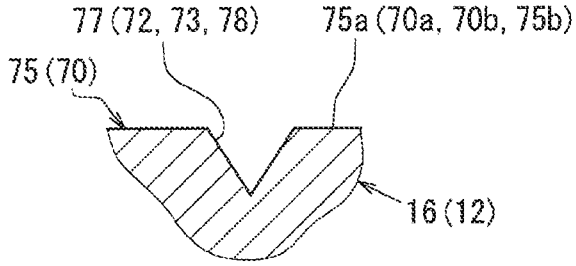
FIG. 9 is a view that corresponds to FIG. 6 showing another example of the first modification.

Specifically, as a first modification, various forms may be used as the form of the longitudinal cross section of the communication grooves 72, 73, 77, 78. As an example of this, as shown in FIG. 7, the communication grooves 72, 73, 77, 78 may be shaped into a U-shape form in the longitudinal cross section thereof. Furthermore, as shown in FIG. 8, the communication grooves 72, 73, 77, 78 may be shaped into a rectangular form in the longitudinal cross section thereof. Furthermore, as shown in FIG. 9, the communication grooves 72, 73, 77, 78 may be shaped into a V-shape form in the longitudinal cross section thereof.

As a second modification, the communication grooves may be formed only on one side of the outer gear 30 and the inner gear 20 in the axial direction Da. As an example of this, the communication grooves may be formed only in the slide surface 75 of the pump casing 16, which is opposite from the joint receiving chamber 58, among the pair of slide surfaces 70, 75.

As a third modification, the communication grooves may be formed only at the eccentric side partitions 70*a*, 75*a* among the eccentric side partitions 70*a*, 75*a* and the opposite side partitions 70*b*, 75*b*.

As a fourth modification, the fuel pump may not include the joint member 60, and the pump housing 11 may not include the joint receiving chamber 58. As an example of this, the rotatable shaft 80*a* and the inner gear 20 may be directly joined together.

As a fifth modification, the suction passage 13 and the discharge passage 17 may be recessed from a common slide surface, and the communication grooves may be communicated with the suction passage 13 and the discharge passage 17 through the opposite groove end parts thereof. Furthermore, the suction groove 18 and the discharge groove 14 may be recessed from a common slide surface, and the communication grooves may be communicated with the suction groove 18 and the discharge groove 14 through the opposite groove end parts thereof.

As a sixth modification, the fuel pump may suction and discharge gasoline other than the light oil, or another type of liquid fuel, which is similar to the light oil or the gasoline.

The invention claimed is:

1. A fuel pump comprising:

an outer gear that includes a plurality of internal teeth;

an inner gear that includes a plurality of external teeth and is meshed with the outer gear while the inner gear is eccentric to the outer gear; and a pump housing that rotatably receives the outer gear and the inner gear, wherein:

when the outer gear and the inner gear are rotated to increase and decrease volumes of a plurality of pump chambers, which are formed between the outer gear and the inner gear, fuel is sequentially drawn into and is discharged from the plurality of pump chambers; and the pump housing includes:

a pair of slide surfaces, which hold the outer gear and the inner gear from two opposite sides, respectively, in an axial direction, so that the outer gear and the inner gear are slid along the pair of slide surfaces;

a suction guide passage that is recessed from at least one of the pair of slide surfaces and guides fuel at a suction side;

a discharge guide passage that is recessed from the slide surface, at which the suction guide passage is formed, wherein the discharge guide passage guides the fuel at a discharge side;

a communication groove that is recessed from the slide surface, at which the suction guide passage and the discharge guide passage are formed, wherein the communication groove is shaped into an arcuate form that extends along a circumcircle of the inner gear, and the communication groove is communicated with the suction guide passage and the discharge guide passage through two opposite groove end parts, respectively, of the communication groove, the slide surface, at which the suction guide passage and the discharge guide passage are formed, includes:

an eccentric side partition that is located on an eccentric side of the inner gear and partitions between the suction guide passage and the discharge guide passage; and an opposite side partition that is located on an opposite side of a rotational center of the outer gear, which is opposite from the eccentric side, wherein the opposite side partition partitions between the suction guide passage and the discharge guide passage; and the communication groove is formed at least in the eccentric side partition among the eccentric side partition and the opposite side partition.

2. The fuel pump according to claim 1, wherein the communication groove is formed in both of the eccentric side partition and the opposite side partition.

3. The fuel pump according to claim 1, comprising:

a rotatable shaft that is rotationally driven; and a joint member that relays the rotatable shaft to the inner gear to rotate the outer gear and the inner gear, wherein:

the pump housing includes a joint receiving chamber that is recessed from one of the pair of slide surfaces, which is located on one side of the outer gear and the inner gear in the axial direction, to receive the joint member; and the communication groove is formed at least in another one of the pair of slide surfaces, which is opposite from the joint receiving chamber.

4. The fuel pump according to claim 1, wherein the communication groove is formed at each of two opposite sides of the outer gear and the inner gear, which are opposite to each other in the axial direction.

5. A fuel pump comprising:

an outer gear that includes a plurality of internal teeth;

an inner gear that includes a plurality of external teeth and is meshed with the outer gear while the inner gear is eccentric to the outer gear;

a pump housing that rotatably receives the outer gear and the inner gear;

a rotatable shaft that is rotationally driven; and a joint member that relays the rotatable shaft to the inner gear to rotate the outer gear and the inner gear, wherein:

when the outer gear and the inner gear are rotated to increase and decrease volumes of a plurality of pump chambers, which are formed between the outer gear and the inner gear, fuel is sequentially drawn into and is discharged from the plurality of pump chambers; and the pump housing includes:

a pair of slide surfaces, which hold the outer gear and the inner gear from two opposite sides, respectively, in an axial direction, so that the outer gear and the inner gear are slid along the pair of slide surfaces;

a suction guide passage that is recessed from at least one of the pair of slide surfaces and guides fuel at a suction side;

a discharge guide passage that is recessed from the slide surface, at which the suction guide passage is formed, wherein the discharge guide passage guides the fuel at a discharge side;

a communication groove that is recessed from the slide surface, at which the suction guide passage and the discharge guide passage are formed, wherein the communication groove is shaped into an arcuate form that extends along a circumcircle of the inner gear, and the communication groove is communicated with the suction guide passage and the discharge guide passage through two opposite groove end parts, respectively, of the communication groove; and a joint receiving chamber that is recessed from one of the pair of slide surfaces, which is located on one side of the outer gear and the inner gear in the axial direction, to receive the joint member, wherein the communication groove is formed at least in another one of the pair of slide surfaces, which is opposite from the joint receiving chamber.

6. The fuel pump according to claim 5, wherein the communication groove is formed at each of two opposite sides of the outer gear and the inner gear, which are opposite to each other in the axial direction.

* * * * *